United States Patent [19]

Gray et al.

[11] Patent Number: 4,578,857

[45] Date of Patent: Apr. 1, 1986

[54] TAMPERPROOF PACKAGE

[75] Inventors: Thomas W. Gray, Toledo; Ralph H. Whitney, Whitehouse, both of Ohio

[73] Assignee: Owens-Illinois, Inc., Toledo, Ohio

[21] Appl. No.: 721,066

[22] Filed: Apr. 8, 1985

Related U.S. Application Data

[60] Division of Ser. No. 606,861, May 4, 1984, Pat. No. 4,530,437, which is a continuation of Ser. No. 373,911, May 3, 1982, abandoned.

[51] Int. Cl.[4] ..... B23P 11/02; B23P 17/00

[52] U.S. Cl. ..... 29/453; 29/418; 29/413

[58] Field of Search ..... 29/413, 416, 418, 451, 29/453; 215/252, 341, 253, 256

[56] References Cited

U.S. PATENT DOCUMENTS

| | | | |
|---|---|---|---|
| 2,841,863 | 7/1958 | Geisler | 29/413 |
| 3,329,295 | 7/1967 | Fields | 215/252 |
| 3,959,601 | 5/1976 | Renck et al. | 29/451 |
| 4,126,240 | 11/1978 | Brach | 215/252 |
| 4,133,462 | 1/1979 | Lindström | 215/252 |
| 4,157,144 | 6/1979 | Weiler | 215/252 |
| 4,196,818 | 4/1980 | Brownbill | 215/252 |

*Primary Examiner*—Howard N. Goldberg
*Assistant Examiner*—Steven Nichols
*Attorney, Agent, or Firm*—John R. Nelson

[57] ABSTRACT

A tamperproof package comprising a container having a neck and an annular radial flange beneath the neck and a plastic closure removably interengaged with the neck. The closure has a top wall and a peripheral skirt. A plastic pilfer band interengages the skirt, such that when the closure is applied to the container, the band is flexed over and engages beneath annular flange on the neck of the container, and when the closure is thereafter removed from the container, the band is prevented from removal from the container and is thereby disengaged from the closure. In a modified form the plastic pilfer band includes an integral liner which is severed from the band and engages the top wall of the closure during assembly of the band to the closure.

3 Claims, 7 Drawing Figures

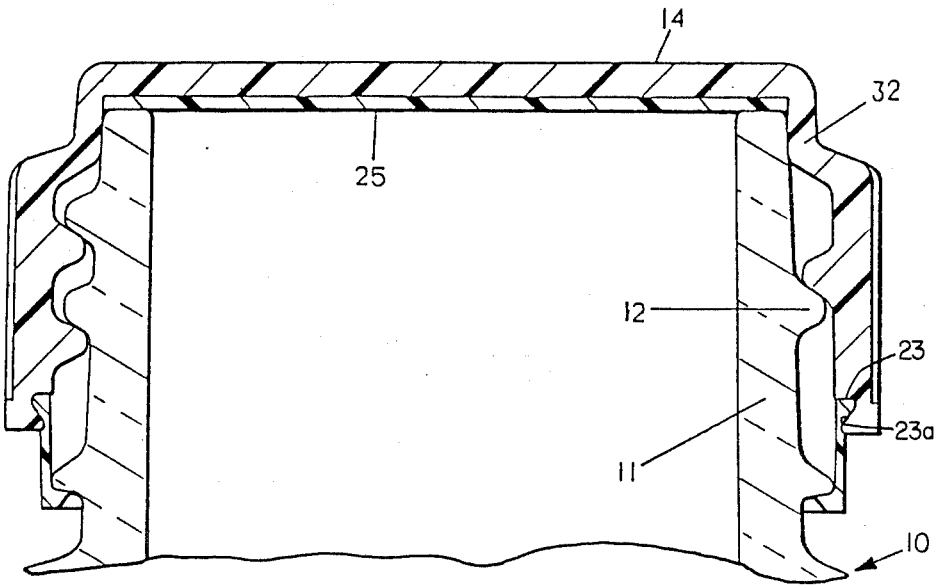
FIG. 3
FIG. 4
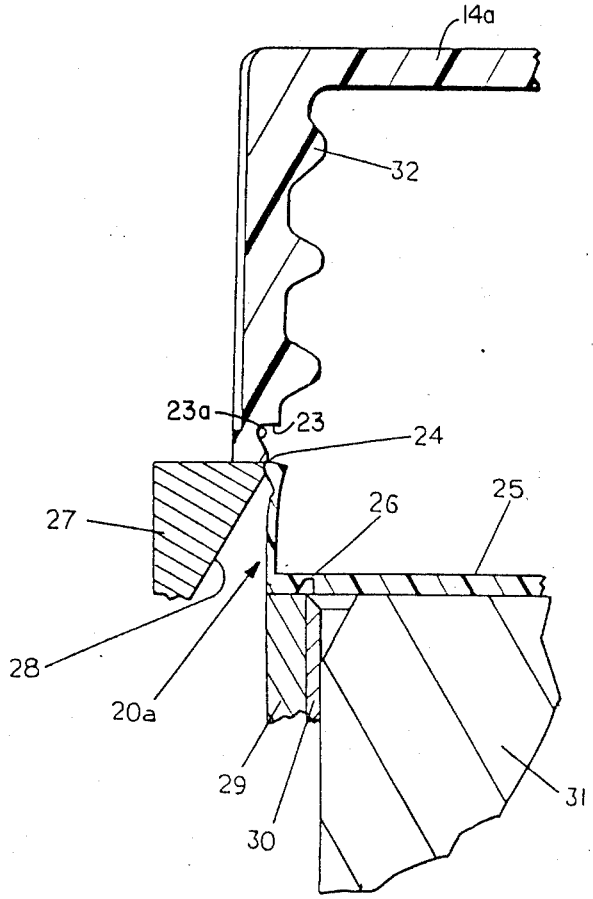

TAMPERPROOF PACKAGE

This is a divisional of co-pending application Ser. No. 606,861 filed on May 4, 1984, now U.S. Pat. No. 4,530,437, which is, in turn, a continuation of application Ser. No. 373,911 filed on May 3, 1982, now abandoned.

BACKGROUND AND SUMMARY OF THE INVENTION

It is common in packaging goods in containers such as bottles to provide a band or tape between the closure and the container which is broken when the closure is removed thereby giving a visual indication of whether the contents have been tampered with.

It has heretofore been proposed that a separate band be provided on the closure which is separated from the closure when the closure is removed or tampered with. See, for example, U.S. Pat. No. 4,157,144, which shows the use of a ring of U-shaped cross section mounted in the recess of the closure.

Among the objects of the present invention are to provide a tamperproof package which utilizes a plastic closure and a plastic band that is adapted to snap into position in the closure, both the closure and the band being preferably made by injection molding; which will effectively indicate that the contents have been tampered with; and which can be produced with minimum change in the closure.

Among the further objects of the invention are to provide a tamperproof package wherein the plastic band includes an integral liner that is severed from the band and applied in position against the top wall of the closure during assembly of the band to the closure.

In accordance with the invention, a plastic pilfer band interengages the skirt, such that when the closure is applied to the container, the band is flexed over the annular flange of the container causing radially inwardly extending portions of the band to extend below the flange of the container and when the closure is thereafter removed from the container, the band is prevented from removal from the container and is thereby disengaged from the closure. In a modified form, the plastic pilfer band includes an integral liner which is severed from the band and engages the top wall of the closure during assembly of the band to the closure.

DESCRIPTION OF THE DRAWINGS

FIG. 3 is a fragmentary sectional view of a modified form of package.

FIGS. 4–7 are fragmentary sectional views showing the assembly apparatus in different positions for assembling the band and liner to the closure.

DESCRIPTION

Figure 1:
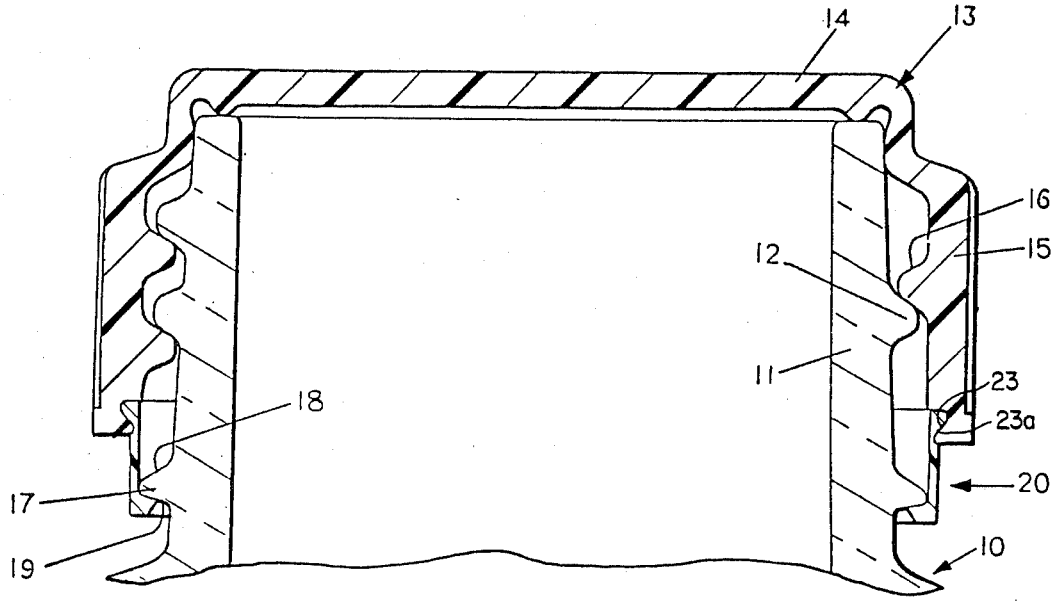
FIG. 1 is a fragmentary vertical sectional view of a package embodying the invention.

Referring to FIG. 1, the tamperproof package comprises a conventional container 10 such as a bottle of glass or plastic having a neck 11 with an external thread 12 thereon. The package further comprises a closure 13 of organic plastic material such as polypropylene having a top wall 14 and a peripheral wall or skirt 15. The skirt 15 has threads 16 on the internal surface complementary to the threads 12 for holding the closure on the container. The container includes a flange 17 below the threads 12.

A band 20 in the form of an annular wall 21 with a radially inwardly extending bead 22 is provided and adapted to engage the flange 17, as presently described. The band 20 has portions thereof interengaging with the interior of the skirt 15. More specifically, the inner surface of the skirt 15 includes an annular recess or notch 23 having a downwardly and inwardly inclined surface **23*a* for receiving an external complementary annular bead 24 on the upper end of the wall 21 of the band 20 having a complementary downwardly and inwardly inclined surface 24*a*. The band is made of similar organic plastic material, and preferably injection molded. In its unrestrained state prior to insertion or engagement with the closure, the outer diameter of the bead 24 is greater than the inner diameter of the lowermost portion of the wall 15 so that in order to assemble the band on the closure, an axial force must be applied to the lower end of the band to cause the bead 24 to snap into recess 23**.

Figure 2:
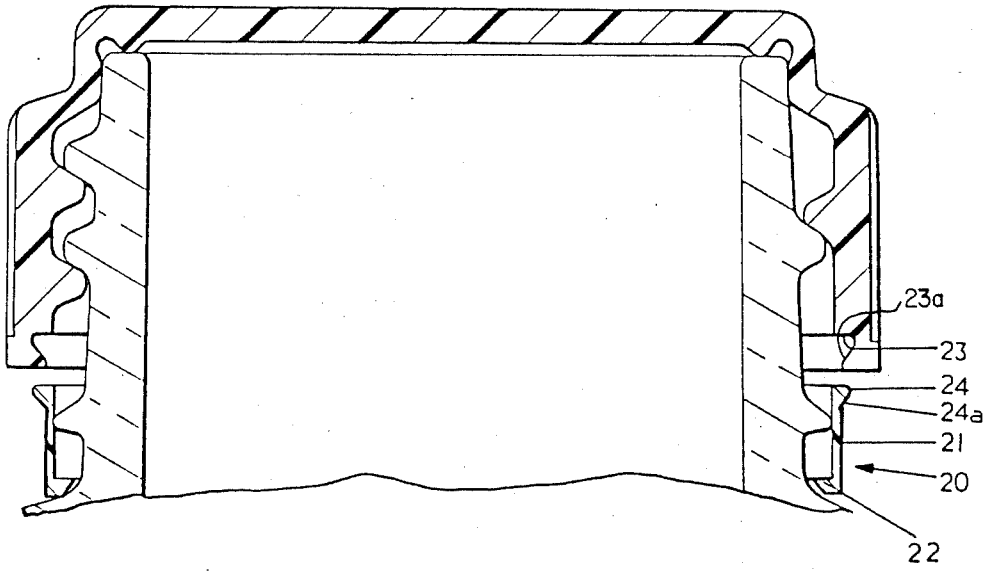
FIG. 2 is a fragmentary sectional view similar to FIG. 1 showing the parts in a different position after the closure has been once removed from the package and reapplied to the package.

In use, the band 20 is first assembled to the closure 13 and the closure 13 is applied to the container. As the closure with the attached band 20 is threaded on the container 10, the bead 22 snaps over the flange 17 on the container 10 as shown in FIG. 1. Upon removal of the closure by unthreading from the neck, the band 20 is restrained against upward movement by interengagement of the flange 17 and bead 22 so that the band snaps out of engagement with the closure as shown in FIG. 2 by movement of surface **24*a* along surface 23*a***, thus indicating that the closure has been tampered with.

It can thus be seen that the tamperproof package utilizes a plastic closure and a plastic band which effectively indicates that the contents have been tampered with. The closure and band can be made of different colors as desired.

In the form of the invention shown in FIG. 3, the package includes a plastic liner 25 interposed between the undersurface of the top wall **14*a* and the top edge of the container neck 11. The liner 25 is formed as an integral part of the band 20*a* and is severed from the band and placed in position against the undersurface of the top wall 14*a***, as presently described.

Referring to FIGS. 4–7, the apparatus for assembling the band **20*a* with the liner 25 connected by a weakened or thinner portion 26 in the closure comprises a plurality of dies including a first die 27 that has a surface 28 tapered upwardly and inwardly, a second die 29 that is adapted to engage the periphery of the end of the band 20*a*, a third die 30 that comprises a knife for severing at the weakened portion 26 and a plunger die 31 for pushing the severed liner 25 up into position adjacent the top wall 14*a***.

Figure 5:
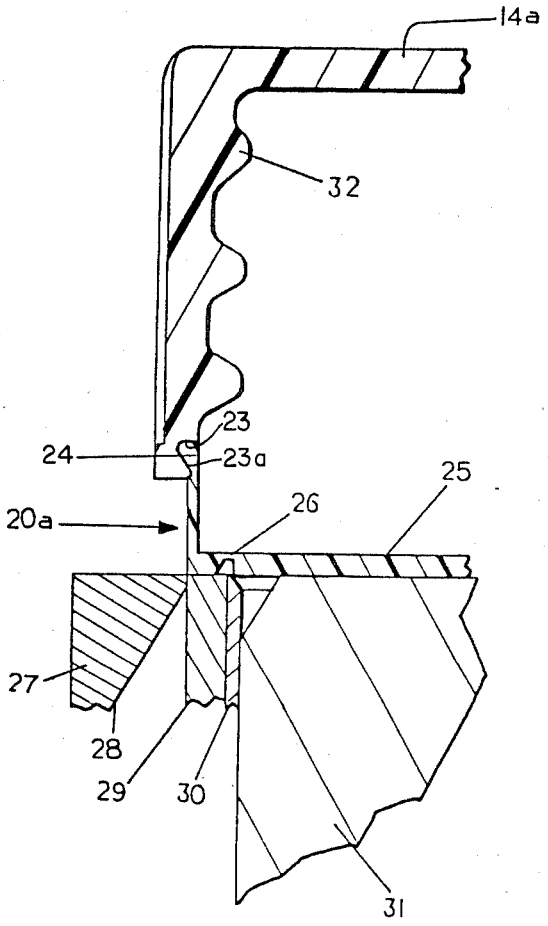
Figure 6:
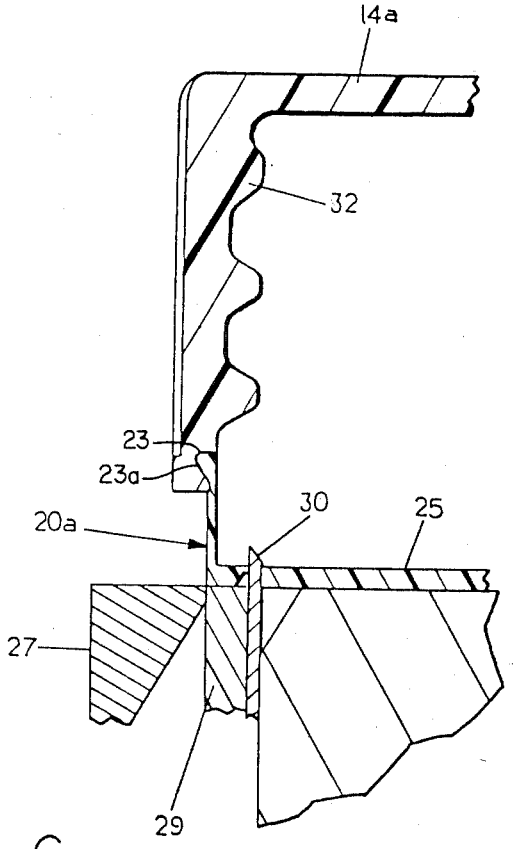
Figure 7:
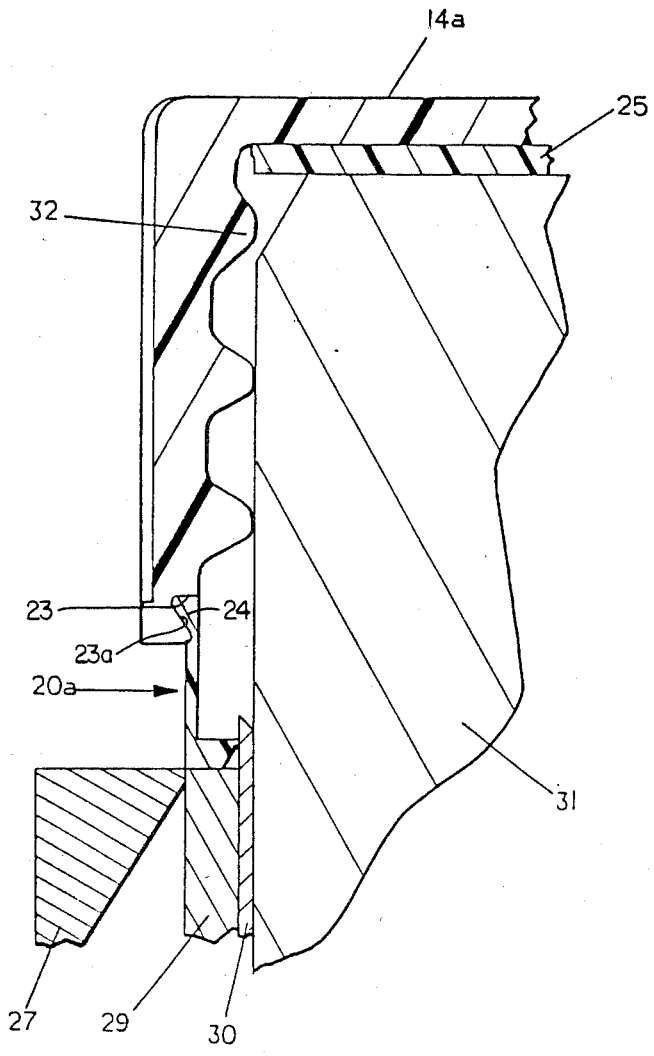

In use, the band **20*a* with the integral liner 25 is placed in position as shown in FIG. 4, and the dies 29, 30, 31 are moved upwardly together causing the upper edge of the band 20*a* to engage the surface 28 radially compressing the band inwardly whereupon the die 28 is retracted permitting the bead 24 to snap outwardly into engagement with the notch 23 on the closure (FIG. 5). The knife die 30 is then moved upwardly severing the liner 25 from the remainder of the band 20*a* (FIG. 6) and the plunger die 31 is then moved upwardly to carry the liner 25 into position adjacent the undersurface of the top wall 14*a* (FIG. 7). The closure includes a small annular bead 32 on the inner surface of the skirt thereof retains the liner 25** in position.

Where the closure does not utilize a liner, the apparatus is similar except that the knife die 30 and plunger die 31 are not used.

We claim:

1. The method of assembling a plastic pilfer band to a closure having a top wall and a peripheral skirt and interengaging means between the closure and neck wherein the pilfer band includes a panel portion connected thereto by an annular weakened portion and adapted to be severed to form the liner for the underside of the top wall of the closure which comprises positioning the pilfer band adjacent the lower extremities of the skirt of the closure, progressively moving the band axially toward the closure while compressing the upper portion of the band radially inwardly to bring the interengaging means of the closure and band into axial alignment, releasing the force on the band to cause said interengaging means to interengage, applying an axial cutting force at the weakened portion to sever the liner from the band, and applying an axial force to the liner to bring it into position adjacent the undersurface of the top wall, thereafter severing the panel portion from the remainder of the band, and applying an axial force to move the severed panel portion into position adjacent the undersurface of the top wall to form a liner for the closure.

2. The method set forth in claim 1 wherein said step of severing is achieved by moving a knife die axially inwardly with respect to the closure and band.

3. The method of assembling a plastic pilfer band to a closure having a top wall and a peripheral skirt and interengaging means between the closure positioning the pilfer band adjacent the lower extremities of the skirt of the closure, progressively moving the band axially toward the closure while compressing the upper portion of the band radially inwardly to bring the interengaging means of the closure and band into axial alignment, releasing the force on the band to cause said interengaging means to interengage.

* * * * *